United States Patent [19]

Siegrist et al.

[11] Patent Number: 4,536,990

[45] Date of Patent: Aug. 27, 1985

[54] TORSIONALLY STIFF LIGHTWEIGHT REFRIGERATOR/FREEZER DOOR

[75] Inventors: Gary D. Siegrist; Edward S. Blain, both of Rockford, Ill.

[73] Assignee: Sundstrand Corporation, Rockford, Ill.

[21] Appl. No.: 378,681

[22] Filed: May 17, 1982

[51] Int. Cl.[3] ..... E06B 3/00

[52] U.S. Cl. ..... 49/501; 52/793

[58] Field of Search ..... 49/501; 52/793

[56] References Cited

U.S. PATENT DOCUMENTS

| | | | |
|---|---|---|---|
| 1,914,646 | 6/1933 | Rand | 52/793 X |
| 2,652,601 | 9/1953 | Slopa et al. | 52/793 |
| 3,250,041 | 5/1966 | Anger | 49/501 |
| 3,720,032 | 3/1973 | Harman | 52/793 X |
| 4,235,057 | 11/1980 | Teeters | 52/793 X |
| 4,282,687 | 8/1981 | Teleskivi | 49/501 X |

*Primary Examiner*—Kenneth Downey

*Attorney, Agent, or Firm*—Harold A. Williamson; Ted E. Killingsworth; James A. Wanner

[57] ABSTRACT

The invention relates to a torsionally stiff door adapted to be mounted for pivotal movement at points on a line parallel to an edge of the door and to be latched at a point along an opposing edge of the door. The door is intended for use in an environment where one side of the door is subject to loading over that surface. The door is also subject to highly directional point loading on the other side of the door. The surface loading and the point loading tend to torsionally bend the door about lines passing through the points, which lines intersect at the latch. The door is fashioned of a pair of spaced apart panels which form respectively one side of the door and the other side of the door.

5 Claims, 11 Drawing Figures

FIG. 1
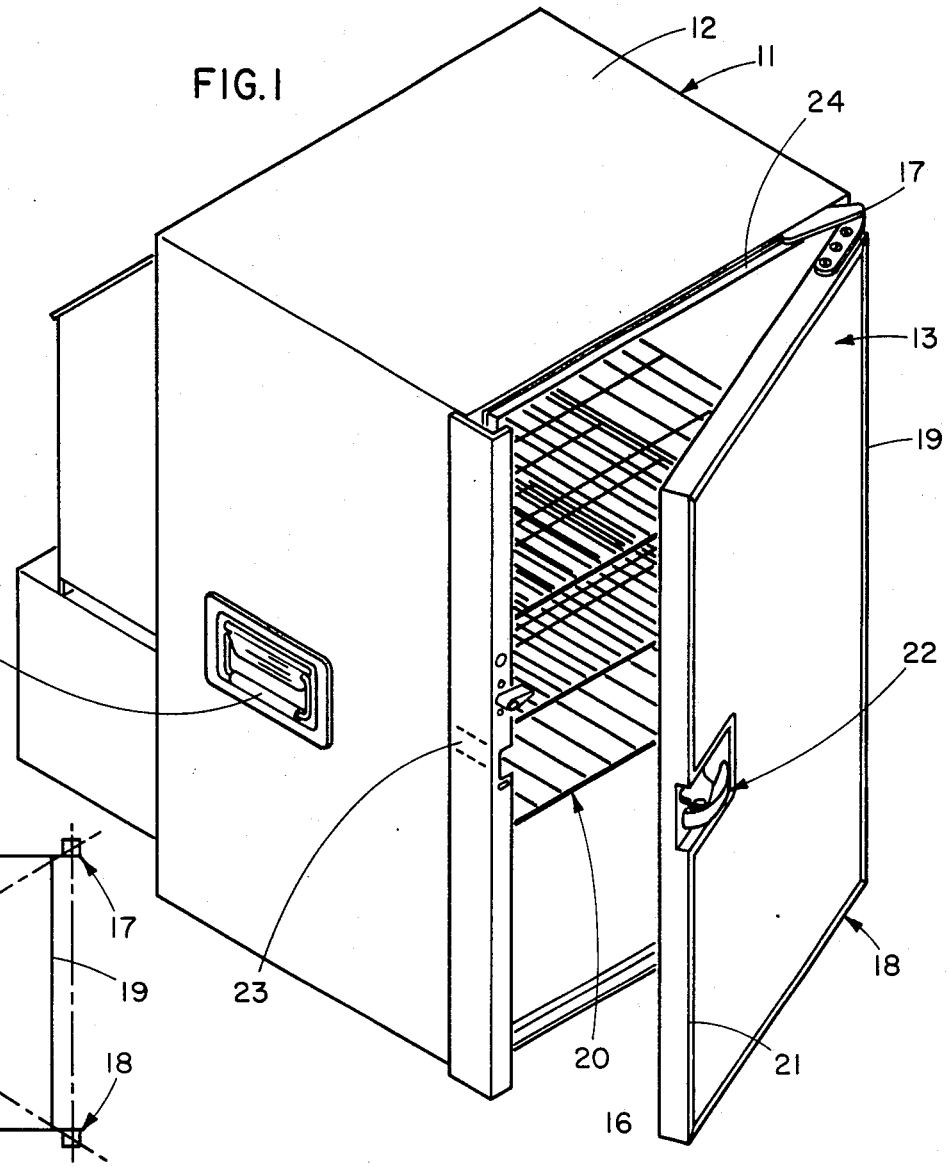
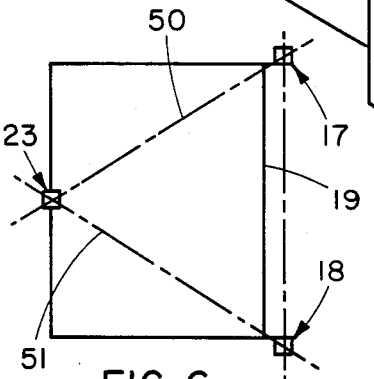
FIG. 6
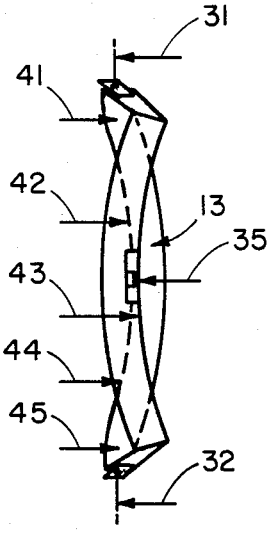
FIG. 5
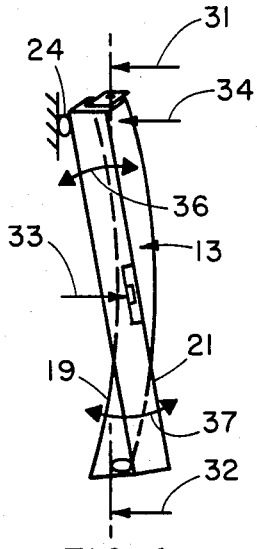
FIG. 4
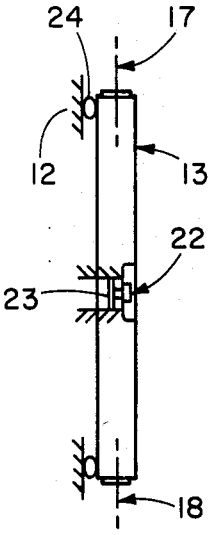
FIG. 3
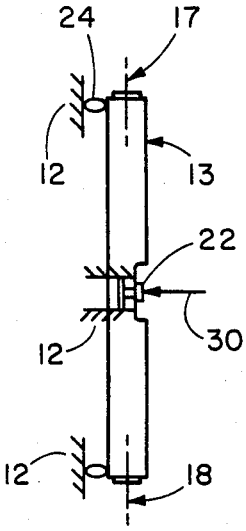
FIG. 2

TORSIONALLY STIFF LIGHTWEIGHT REFRIGERATOR/FREEZER DOOR

TECHNICAL FIELD

This invention relates to a torsional stiff door structure.

BACKGROUND ART

Improved door construction has been for thousands of years a matter of continuing interest and remains of interest today. Invariably the environment in which the door is to be utilized dictates the nature of the doors construction. The galley of modern aircraft is an environment in which there are many compartments, some of which house refrigerators or freezers. The requirements that doors for galley refrigerator/freezer compartments must meet are different than refrigerator/-freezer doors located in other non-airborne environments. Of primary concern in aircraft galleys is the fact that the crash of the aircraft must be considered. When this possible happening is taken into account, it will be appreciated that the refrigerator/freezer door must be able to withstand sudden impact loading of the refrigerator/freezers entire contents against the inside of the door, should the plane go down. Absent the presence of a door with sufficient strength, the contents would be converted into deadly missiles within the aircraft cabin.

Those individuals familiar with aircraft galleys are no doubt impressed by the compactness of the equipment and the relatively small area within which the flight attendants must move. It is not uncommon to open and close a galley compartment door during a flight a dozen or more times. Typically, compartment doors are provided with a latch mechanism positioned midway along the edge of the door. This latch location optimizes the doors capacity to handle a sudden impact loading experience from within. The location of the latch as just described, however, gives rise to a practical problem of insuring that the door is latched after every usage. The doors of the prior art invariably required a delivering of a direct force to the door from a point in the immediate vicinity of the latch in order to cause the latch to be secured. Aircraft cabin attendants are frequently in a rush, especially on flights of short duration where passenger serving time is limited. These attendants, when rushed on most occasions, hit the door at an upper corner or use their knee to push the door to a closed and latched condition. This point loading of the door is most often not delivered to the door front near the latch. In order that the refrigerator/freezer door be provided with a sealed environment, there is provided between the door and the refrigerator/freezer compartment surface, against which the door is closed, a resilient strip of material. When, for example, the door is normally pushed closed with point pressure applied at an upper corner of the door, the resilient material is compressed and the force transmitted through the door to the latch mechanism. If the door is not extremely stiff, the door tends not to fully latch. It is therefore believed apparent that an ideal door should be torsionally stiff and capable of withstanding a sudden loading from within. The door closing procedure outlined above has resulted in prior art doors being repeatedly flexed or racked back and forth until the door finally becomes structurally loose, weak and will not latch.

Merely making the door stronger by making it of heavier material is an unacceptable solution. In the past, when aircraft fuel was cheap, the weight of such doors was not critical. Some aircraft manufactures today assess the fuel cost per pound over the useful commercial life of an aircraft at $150.00 per pound or more. The door embodying the invention to be described hereinafter provides a door that is several pounds lighter than is presently available in the market place. The door is torsionally stiff and can withstand a possible impact loading from within, without structurally failing.

As noted at the outset, door construction has been evolving over the years. New materials that are light and strong, such as fiberglass and foam insulation, have found their way into door construction. Typical of such a door having a rigid plastic skin made of a polyester resin glass fiber mixture and filled with insulating foam, is that found in the Vincent Di Maio Pat. No. 3,950,894. The Di Maio door is intended for use as an architectural door for a dwelling. Although the Di Maio door is light in weight and insulated, no provision is made for the door to withstand internal impact loading and point applied closing forces to its outside. All structural features which overcome the problems of impact loading and point applied closing forces are incorporated in the door of the preferred embodiment of the invention to be described more fully hereinafter.

The patent to Slopa, et al, U.S. Pat. No. 2,652,601 is a typical refrigerator door of the prior art which recognizes the utility of providing diagonal sheet metal stripes 25 across the face of the door to make the door more resistant to torsional loading. The Slopa, et al refrigerator door does not, however, suggest as the invention to be described contemplates, intersecting support members within a door in which support members are secured to spaced apart panels which comprise the front and rear panels of the refrigerator door.

By way of further example of the prior art, the patent to Donald D. Andresen, U.S. Pat. No. 4,294,055 is directed to a honeycomb overhead door with stiffening members 34 and 36. Each of the stiffening members 34, 36 are made up of a honeycomb core 38 which is covered by opposite strips 40. While these stiffeners 34, 36 as shown are sandwiched between plywood veneer, there is no appreciation of the advantageous consequences of bonding a channel shaped support member to a pair of spaced apart panels as the invention to be described provides.

Although the patent to Harman, U.S. Pat. No. 3,720,032, is directed to a lightweight panel construction in which there are provided concentrically disposed corrugations of rectangular cross-section between plastic front and rear panels 14, 16, there would be no motivation to use the panel as a refrigerator door even with the diagonal tensioning members 24, because though the door so formed would be light in weight, it would not provide a torsional stiff door structure of the type required.

DISCLOSURE OF THE INVENTION

The invention is directed to a torsionally stiff door adapted to be mounted for pivotal movement at points on a line parallel to an edge of the door and to be latched at a point along an opposing edge of the door. The door is intended for use in an environment where one side of the door is subject to loading over that surface. The door is also subject to highly directional point loading on the other side of the door. The surface loading and the point loading tend to torsionally bend the door about lines passing through the points, which lines intersect at the latch. The door is fashioned of a pair of spaced apart panels which form respectively one side of the door and the other side of the door.

The door includes at least two intersecting support members, each having ends generally contiguous with the edges of the panels which form the sides of the door. Each support member has at least two surfaces integrally secured over the length of the members to an adjacent surface of the spaced apart panels to thereby establish a door that is torsionally stiff when receiving the surface loading in one direction and the point loading in an opposing direction.

It is therefore a primary object of this invention to utilize intersecting support members secured to spaced apart panels to provide a torsionally stiff door.

Another object of the invention is to provide a torsionally stiff door structure by utilizing U-shaped channels as intersecting support members, wherein the channels include laterally extending flanges. The flanges each have a surface integrally secured to an adjacent surface of one of a pair of spaced apart panels. Each U-shaped channel has another surface secured to another adjacent surface of the other panel.

Yet another object of the invention is to provide a torsionally stiff door that provides exceptional thermal insulating qualities as a consequence of the provision of thermal insulating material filling all space between the panels not filled by the structure of the intersecting support members of the door.

A final object of the invention is to provide a high strength door that is restrained at a latch and two hinge points, which door is low in cost, light in weight and utilizes thermal insulation to establish a structural arrangement that is extremely rigid and resistant to torsional and axial loads.

In the attainment of the foregoing objects, the invention contemplates a torsionally stiff door structure having a latch edge and a hinge edge. The structure includes the following combination of components: a pair of spaced apart panels which form respectively one side of the door and another side of the door. The panels each have integrally formed at the periphery thereof, side members projecting towards each other. One of the panels has an overall size slightly smaller than the other panel in order to thereby allow the projecting side portions to nest one within the other.

At least two intersecting U-shaped channel support members each have ends generally contiguous to the latch edge and the hinge edge of the door. The U-shaped channels each have laterally extending flanges with each of the extending flanges integrally secured over the length of the members to the same adjacent surface of one of the spaced apart panels. Each of the U-shaped channels has an outer surface integrally secured over the length of the channel to an adjacent surface of the other panel. The space between the panels not filled by the structure of the support members is filled with thermally insulating material integrally bonded to the panels. In the preferred embodiment the thermally insulating material is integerally bonded to the panels and is free from a bond to the support members.

Rigid support blocks are located between the panels along the hinge edge of the door. The support blocks are integrally secured to the panels and to at least one of the support members. A latch support block is integrally mounted between the panels. The latch support block is integrally secured to at least one of the support members.

In the preferred embodiment of the invention the door includes two sets of intersecting support members integrally secured to and between the panels such that each of said intersecting support members has at least one each of the support members of the sets integrally secured one to the other.

Other objects and advantages of the present invention will be apparent upon reference to the accompanying description when taken in conjunction with the following drawing:

BRIEF DESCRIPTION OF THE DRAWINGS

FIG. 1 is a three dimensional illustration of a refrigerator/freezer for use in an aircraft galley, FIG. 2 is a schematic showing of a refrigerator/-freezer door positioned just prior to closing, FIG. 3 is a schematic showing of a refrigerator/-freezer door in a closed position, FIG. 4 is a schematic of the point force loading and deflection of a prior art refrigerator/freezer door during closing, FIG. 5 is a schematic of the surface force loading and deflection of a prior art refrigerator/freezer door experiencing internal impact loading, FIG. 6 is a schematic of refrigerator/freezer door front.

BEST MODE FOR CARRYING OUT THE INVENTION

Figure 7:
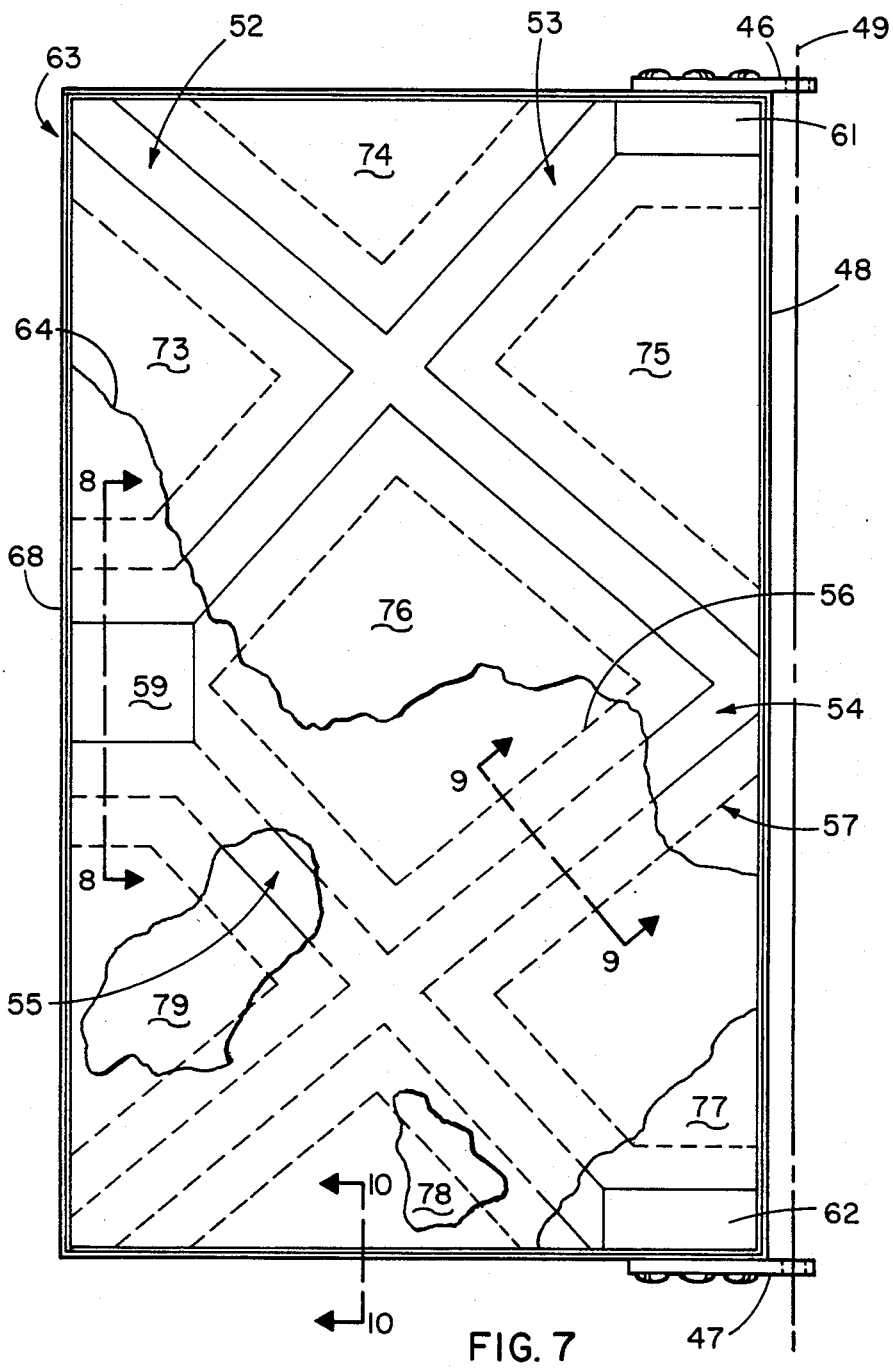
FIG. 7 is a refrigerator/freezer door embodying the invention.

Reference is now made to FIG. 1 which illustrates in three dimensional form a refrigerator/freezer 11 of the type with which the invention finds utility. The refrigerator/freezer 11 hereinafter referred to as a refrigerator, is of a conventional external configuration suited for use in a typical aircraft galley. The structure of the refrigerator 11 includes a cabinet 12 on which is mounted a door 13. The door includes a front face or panel 14, and a rear face or panel 16. Hinges 17, 18 secured as shown in a conventional fashion to the cabinet 12 and the door 13 allows the door 13 to be opened and closed by the pivotal movement of the door 13 about a line passing through the hinges 17, 18, which line is parallel to a hinge edge 19 of the door.

The door 13 has what is termed a latch edge 21 which has disposed centrally thereof a conventional refrigerator door handle designated generally by arrow 22. A latch piece 23 secured to the cabinet 12 cooperates with the door handle 22 to secure the door 13 in a closed position. Typical for this type of refrigerator/freezer there is provided a resilient compressable gasket 24 secured to the cabinet 12 as shown. A pair of refrigerator carrying handles, one of which 15 is shown, are provided to carry the refrigerator 13 to and from the aircraft galley. As would be expected, the refrigerator 12 is provided with shelving 20 on which are stored the items sought to be maintained in a chilled, or as the case may be, a frozen condition.

Reference is now made to FIGS. 2 through 4 which illustrate in schematic form an end view of a refrigerator door 13 in various positions and experiencing different force loadings. It is to be understood that FIGS. 4 and 5 depict in an exaggerated manner, door flexure during loading. The door construction of the subject invention prevents the types of door flexure illustrated in FIGS. 4 and 5.

FIG. 2 is intended to show a latch edge end view of door 13 cooperating with a latch 23 and resilient compressable gasket 24. In this figure, the door 13 has not been closed as evidenced by the showing of the compressable gasket 24 in a full and uncompressed condition. The latch 23 and compressible gasket 12 are shown schematically supported by cabinet 12.

FIG. 3 shows the door 13 closed and latched. In a greatly exaggerated manner the gasket 24 is shown flatened and deformed in its compressed state. In the state shown in FIG. 3, the refrigerator contents are maintained free from thermal losses due to the passage of cooled air from the cabinets interior, to that of the galley environment in which the refrigerator is utilized.

FIG. 3 is intended to illustrate the typical forces and door flexures that tend to arise when a door 13 is attempted to be closed by other than a force applied to the door handle 22, such as force 30 in Figure 2.

In many aircraft galley sections the refrigerator is housed in an opening that has a bottom surface flush with the floor, on which the cabin attendants stand. In this position, the refrigerator closing/opening handle 22 can only be reached if the cabin attendant bends over or stoops. During the press of food service activity, the attendants typically stoop to grasp the handle 22 and open the door 13, and then apply a point force with their knee or hand near the top of the door to effect a closing of the door. This door closing point loading is characterized by force arrow 34 shown near the top of the door 13 in FIG. 4. If the door 13 were perfectly rigid, the force 34 would be transmitted through the door to the latch/handle 23/22, and the door would attain the closed and sealed arrangement of FIG. 3. Doors typical of the prior art construction are not so rigid as to allow this to happen. Typically, the force 34 applied to the door 13 causes the door to flex in the manner shown, which results in the attendant compression and deformation of compressible gasket 24. The presence of the door closing point force 34 results in the appearance of a number of reaction forces. In FIG. 4, three such forces are as shown, namely a pair of hinge reaction forces 31, 32 and a latch reaction force 33. These reaction forces 31, 32, 33, in combination with the point closing force 34, torsionally load the door 13. The repeated application of a point closing force 34 results in the repeated movement of the door 13 as indicated by arrows 36, 37 and the bowing of door 13 hinge edge 19 as shown. The latch edge 21 of the door tends to assume the condition illustrated in an exaggerated manner. This repeated door flexing is commonly referred to as "racking". This racking in time causes the door structure to loosen with the attendant consequences that the door becomes so loose that point loading forces will no longer cause the door to latch.

The invention to be described hereinafter completely removes the problem of racking while simultaneously providing a door that is lighter in weight and is more thermally efficient than that of the known prior art.

FIG. 5 illustrates a door 13 that experiences a surface loading arising from within the refrigerator, such as that which would arise should the aircraft carrying the refrigerator crash.

FIG. 5 shows a plurality of surface door loading arrows 41, 42, 43, 44, 45, which are reacted against the hinges 17, 18 and the latch 23 shown respectively by reaction force arrows 31, 32 and 35. The flexing and bowing of the door are as illustrated.

In FIG. 6 there is shown a front view of the door 13 of FIG. 5 as it experiences the just described loading that results in the torsional bending of the door. In studying FIG. 6, it will be appreciated that the surface loading, as well as the point loading described in respect of FIG. 4, will result in the torsional bending of the door 13 about the lines 50, 51, which lines pass through the hinges 17, 18 at points on a line parallel to the hinge edge 19 that intersects the lines 50, 51 at the hinges 17, 18. The lines 50, 51 intersect at a point defined at the latch 23.

This just described torsional loading has resulted in the prior art doors structurally failing and allowing the refrigerator/freezer contents to be hurled about the cabin, thereby further threatening the survival of aircraft occupants. It would be indeed lamentable to survive a crash only to be maimed by a flying frozen steak.

In the foregoing description, a door 13 which does not incorporate the invention has been described. In the description that follows in respect of FIGS. 7, 8, 9, 10 and 11, a door 63 will be described that incorporates the invention in its preferred embodiment. It should be understood that the external appearance of the door 63 is identicial to the door 13 of FIG. 1, and that the door 63 will experience all of the loading factors considered in the discussion in respect of FIGS. 2 through 6. The structure of door 63 of the preferred embodiment, however, overcomes the aforementioned prior art door deficiencies and provides a new and improved door that is torsionally stiff.

Figure 10:
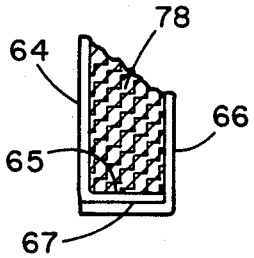
FIG. 10 is a sectional view taken along line 10—10 in FIG. 7.

Referring now to FIG. 7, there is shown a torsionally stiff door 63 which has a hinge edge 48 and a latch edge 68. The door is formed of spaced apart panels 64 and 66. Front panel 64 in FIG. 7 is shown with portions removed in order to facilitate the description of the structural components that cooperate with the panels 64 and 66. When FIG. 10 is studied in conjunction with FIG. 7, it will be appreciated that the panel 64 has integrally formed at its periphery a side member 65 which projects as shown toward the rear panel 66. In a like fashion, the rear panel 66 has as its periphery a side member 67 which projects towards the front panel 64. In the preferred embodiment, the front panel 64 has been selected to have an overall size smaller than the rear panel 66, which thereby allows the projecting side portions 65, 67 to nest one within the other.

Figure 9:
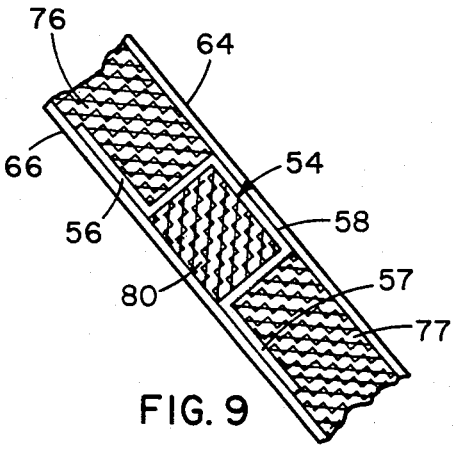
FIG. 9 is a sectional view taken along line 9—9 in FIG. 7.

In FIG. 7 there can be seen that there are provided, two pairs of intersecting U-shaped channels 52, 53, 54, and 55. The cross-sectional configuration of the U-shaped channels can best be observed upon study of FIG. 9 which depicts the channel 54 in section. In FIG. 9 it will be observed that the channel is provided with laterally extending flanges 56, 57. Each of the extending flanges 56, 57 is integrally secured over its entire length to the rear panel 66 by a suitable adhesive. The surface 58 of the U-shaped channel 54 is also integrally secured over the entire length of the channel to the front panel 64 by a suitable adhesive. The U-shaped channels 52, 53, 54 and 55 are fabricated of molded fiberglass reinforced plastic composite. It should be understood that the intersecting U-shaped channel support members 52, 53, 54 and 55 are form, i.e., molded, into a single unitary structure. The front and rear panels 64, 66 with their respective projecting side members 65, 57 are also fabricated of molded fiberglass reinforced plastic. The basic structure of the door embodying the invention is comprised of a molded front and rear panel, and the molded intersecting U-shaped channel support members.

In FIG. 7 it will be noted that the solid plastic support blocks 61, 62 are provided at the ends of channels 53 and 55. Hinge plates 46, 47 are secured to these blocks 61, 62 and the blocks 61, 62 are bonded between the panels 64, 66 and to the channels 53 and 55. It will also be observed when FIG. 7 is studied in conjunction with FIG. 8, that U-shaped channel 53, at its left hand end as FIG. 7 is viewed, as well as, channel 55 turn from a generally diagonal direction to a direction that is parallel with the top and bottom edges of the door. A latch handle support recess 59 is thereby formed by the just described structure. A solid phenolic block 60 is secured between the intersecting molded channels and the front panel 64, as can best be seen in FIG. 8. It is a fair observation to say that the intersecting U-shaped channels 52, 53, 54 and 55 have ends that are generally contiguous with the latch edge 68 and the hinge edge 48 of the door 63.

The door is provided with pre-shaped insulating pieces 73, 74, 75, 76, 77 and 79. The insulation consists of a core material made from blended plastic resins. An ideal material for this insulation is sold under the name Klegecell. Klegecell has a structure that is cellular with each cell being closed, gas-tight, waterproof and filled with an inert gas. Klegecell has an extremely high strength to weight ratio with thermal conductivity comparable to the best insulation known.

Figure 8:
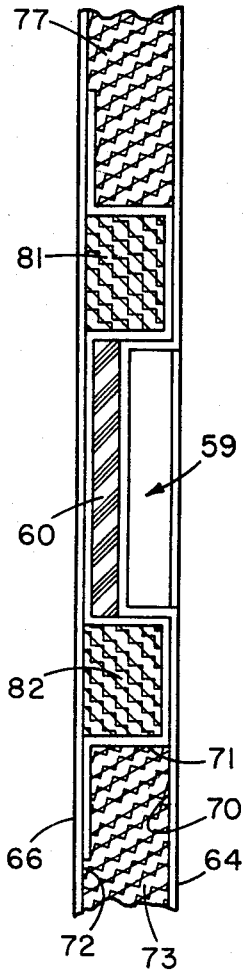
FIG. 8 is a sectional view taken along line 8—8 in FIG. 7.

In the preferred embodimennt, the insulation pieces are bonded with adhesive to the front and rear panels 64, 66. FIG. 7 shows the bonding at surfaces indicated by reference numerals 70 and 72. The side 71 of the insulating pieces such as piece 73, FIG. 8, are not bonded to the channels.

Each of the channels 52, 53, 54 and 55 are also filled with insulating material of the same type. In FIG. 8 and 9 this material is indicated by reference numerals 80, 81 and 82.

It will be recalled from the earlier discussion of the force analysis that produced torsional loading to the door results in two primary stresses and these can be characterized as transverse and longitudinal shear stresses. The transverse shear stresses cause any longitudinal members that are incorporated within the door to twist as is common in the prior art. The longitudinal shear stresses cause cross braces and end members in prior art door to twist.

The door 63 embodying the invention reacts these two stresses in the intersecting support members, the stresses being opposite to each other in direction, cancel at an angle of 45°, where the stresses will combine to produce maximum diagonal tensile and compressive stresses. These intersecting or diagonal stresses then tend to cause bending rather than twisting. Since the U-shaped channel support, when bond to panels 64 and 66 create closed box beams, the tendency to bend is reduced, thereby greatly enhancing the doors ability to withstand torsional loading.

Figure 11:
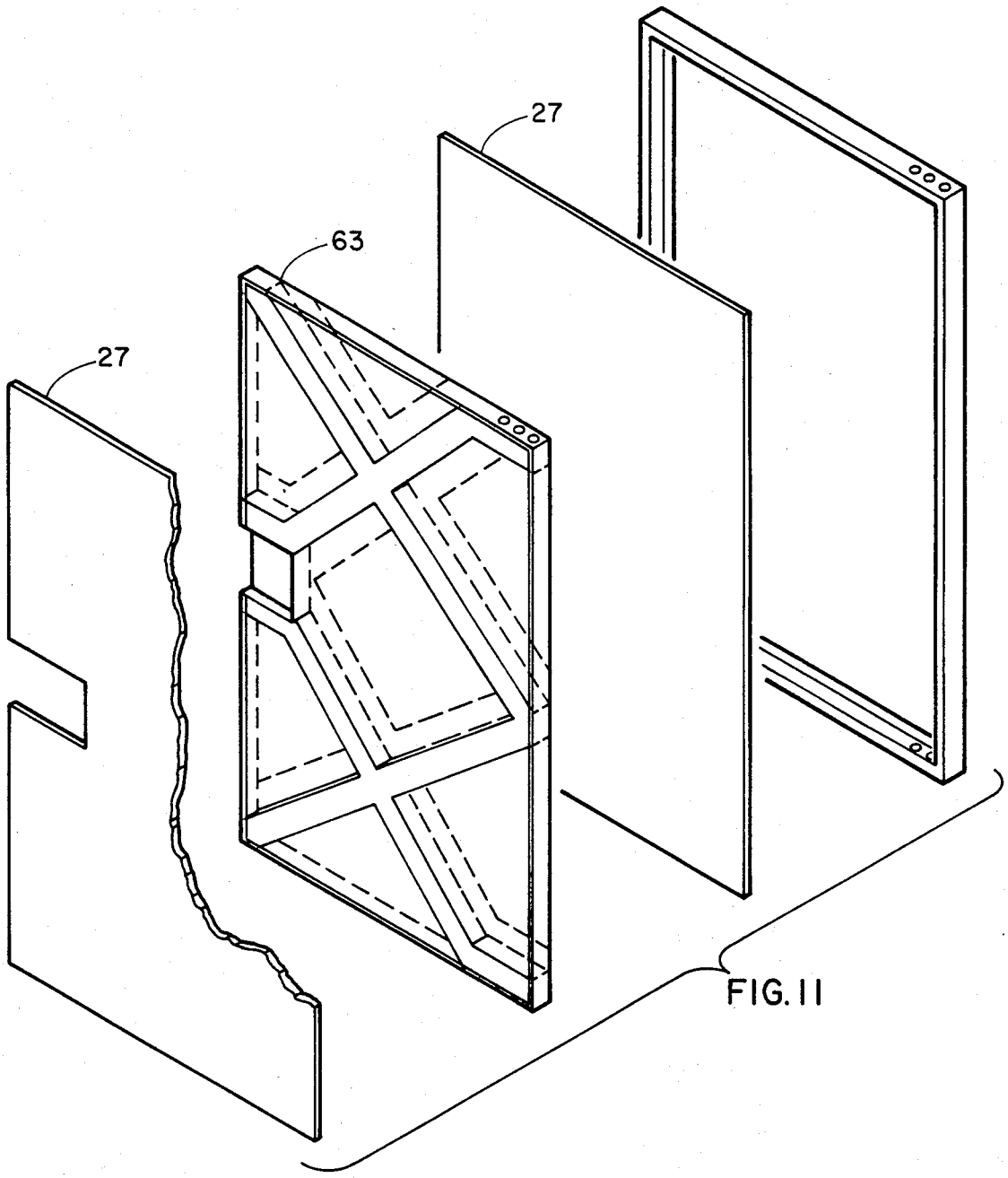
FIG. 11 is an exploded view of a completed door ready for incorporation in a refrigerator/freezer environment.

Reference is now made to FIG. 11 which illustrates in an isometric exploded view, all the components of a door embodying the invention which door would find utility for use in the refrigerator/freezer of FIG. 1.

The door when finally assembled would include the door structure 63, as well as decorative front and rear coverings 26, 27, and a metal frame shaped decorative trim strip not referenced. The coverings 26, 27 may be made of a plastic covered material with an adhesive backing much like contact paper.

Although this invention has been illustrated and described in connection with the particular embodiment illustrated, it will be apparent to those skilled in the art that various changes may be made therein without departing from the spirit of the invention as set forth in the appended claims.

We claim:

1. A torsionally stiff door structure mounted for pivotal movement at an upper and lower point on a line parallel to a hinge edge of said door, said door having a latch means at a point on an opposing latch edge of said door, said door structure, comprising in combination:

a pair of spaced apart panels forming respectively one side of said door and another side of said door, said door experiencing a loading over the surface of said one side of said door, as well as, a highly directional opposing point loading on the other side of said door at a point near an upper portion of said door near said latch edge of said door, said surface loading and point loading tending to establish a bending moment about a first and second line, said first line passing through said upper point and intersecting a second line of said latch point, said second line additionally passing through said lower point, at least two sets of intersecting U-shaped channel support members, each set having ends generally contiguous with said latch edge and said hinge edge, said U-shaped channels having laterally extending flanges, each support member of each of said sets of intersecting U-shaped channel support members having said extending flanges integrally secured over the length of said members to an adjacent surface of said spaced apart panels, each of said U-shaped channels having an outer surface integrally secured over the length of said channel to an adjacent surface of the other of said panels to thereby form a continuous box beam to transfer stresses to said space apart panels, rigid support means between said panels along said hinge edge, said support means integrally secured to said panels and to said U-shaped channel support member ends contiguous with said hinge edge, latch support means integrally mounted between said panels, said latch support means integrally secured to at least one of said U-shaped channel support members of each of said sets of intersecting U-shaped channel support members to thereby establish a door that is torsionally stiff when receiving said surface loading in one direction and said point loading in an opposing direction.

2. The door of claim 1 wherein all space between said panels not filled by the structure of said support members is filled with thermally insulating material integrally bonded to said panels.

3. The door of claim 1 wherein said thermally insulating material integrally bonded to said panels is free from a bond to said support members.

4. The door of claim 3 wherein said panels each have integrally formed at the periphery thereof, side members projecting towards each other, one of said panels having an overall size slightly smaller than the other panel in order to thereby allow said projecting side portions to nest one within the other.

5. The door of claim 4 wherein said panels are made of fiberglass reinforced plastic.

* * * * *